US008358076B2

(12) United States Patent
Kim et al.

(10) Patent No.: US 8,358,076 B2
(45) Date of Patent: Jan. 22, 2013

(54) DRIVER FOR PLASMA DISPLAY PANEL HAVING SEPARATED BOARD STRUCTURE

(75) Inventors: Kyung Hyun Kim, Seoul (KR); Youn Ik Nam, Gyunggi-Do (KR); Jae Han Yoon, Gyunggi-Do (KR); Kwang Hun Song, Gyunggi-Do (KR); Sung Uk Lee, Gyunggi-Do (KR); Peel Sik Jeon, Gyunggi-Do (KR); Dong Kyun Ryu, Seoul (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 436 days.

(21) Appl. No.: 12/689,030

(22) Filed: Jan. 18, 2010

(65) Prior Publication Data

US 2011/0074299 A1 Mar. 31, 2011

(30) Foreign Application Priority Data

Sep. 30, 2009 (KR) ..... 10-2009-0093270

(51) Int. Cl.
*G09G 3/10* (2006.01)

(52) U.S. Cl. ..... 315/169.4; 315/291; 315/307; 345/102; 345/204; 345/205

(58) Field of Classification Search .... 315/169.1–169.4, 315/209 R, 291, 307; 345/76–81, 87–102, 345/204, 211
See application file for complete search history.

(56) References Cited

U.S. PATENT DOCUMENTS 7,471,047 B2 * 12/2008 Ogawa ..... 315/169.4
2007/0165017 A1 * 7/2007 Kubota et al. ..... 345/211
2008/0007490 A1 * 1/2008 Onozawa ..... 345/70

FOREIGN PATENT DOCUMENTS

KR 1020040097464 A 11/2004
KR 1020080054007 A 6/2008

OTHER PUBLICATIONS

Korean Office Action for patent application No. 10-2009-0093270, issued Jan. 7, 2011.

* cited by examiner

*Primary Examiner* — Jimmy Vu
(74) *Attorney, Agent, or Firm* — Lowe Hauptman Ham & Berner LLP

(57) ABSTRACT

There is provided a driver for a plasma display panel having a separated board structure that can reduce parasitic resonance by shortening the length of a cable used for power transmission by separating a board having a Y electrode switch thereon from a board having an X electrode switch thereon. A driver for a plasma display panel having a separated board structure according to an aspect of the invention may include: a first board having a predetermined mounting area, and mounted with a power supply section having predetermined inductance and converting commercial AC power into predetermined driving power using the inductance, and a first electrode switch section, switching the driving power from a power conversion section and supplying the switched driving power to a first electrode of a plasma display panel; and a second board having a predetermined mounting area, physically separated from the first board, and mounted with a second electrode switch section receiving the driving power from the power supply section through a cable and switching the driving power to supply the switched driving power to a second electrode of the plasma display panel.

11 Claims, 13 Drawing Sheets

DRIVER FOR PLASMA DISPLAY PANEL HAVING SEPARATED BOARD STRUCTURE

CROSS-REFERENCE TO RELATED APPLICATIONS

This application claims the priority of Korean Patent Application No. 10-2009-0093270 filed on Sep. 30, 2009, in the Korean Intellectual Property Office, the disclosure of which is incorporated herein by reference.

BACKGROUND OF THE INVENTION

1. Field of the Invention

The present invention relates to a driver for a plasma display panel, and more particularly, to a driver for a plasma display panel having a separated board structure that can reduce parasitic resonance by shortening the length of a cable used for power transmission by separating a board having a Y electrode switch thereon from a board having an X electrode switch thereon.

2. Description of the Related Art

In general, a plasma display panel includes a plurality of unit cells, each of which includes a front panel, a rear panel and separation walls interposed therebetween. Each unit cell is filled with a main discharge gas, such as neon (Ne) or helium (He), and an inert gas containing a small amount of xenon (Xe). When this plasma display panel is discharged by high frequency voltage, the inert gas causes vacuum ultraviolet rays, and phosphors formed between the separation walls emit light, thereby displaying an image. Therefore, a power supply that applies high frequency voltage to the plasma display panel is necessarily employed.

The above-described plasma display panel is attracting attention as a display device in that it is thin and lightweight.

Due to price competition between liquid crystal displays and display devices using plasma display panels, there is a need for a reduction in product weight, thickness, size and manufacturing costs. This same applies to power supplies for plasma display panels.

As for these power supplies for plasma display panels, an integrated board structure in which a power conversion circuit, a Y electrode switch and an X electrode switch are arranged within a single board, is under consideration.

Power, which is switched through a Y electrode switch and an X electrode switch, needs to be transmitted to a Y electrode and an X electrode arranged at both sides of a plasma display panel. Here, cables are necessary to transmit the power. However, parasitic inductance components, being generated in proportion to the cable length, cause the distortion of waveforms of the power being transmitted, and undesirable heat is generated in the electrode switches.

SUMMARY OF THE INVENTION

An aspect of the present invention provides a driver for a plasma display panel having a separated board structure that can reduce parasitic resonance by reducing the length of a cable used for power transmission by separating a board having a Y electrode switch thereon from a board having an X electrode switch thereon.

According to an aspect of the present invention, there is provided a driver for a plasma display panel having a separated board structure, the driver including: a first board having a predetermined mounting area, and mounted with a power supply section having predetermined inductance and converting commercial AC power into predetermined driving power using the inductance, and a first electrode switch section, switching the driving power from a power conversion section and supplying the switched driving power to a first electrode of a plasma display panel; and a second board having a predetermined mounting area, physically separated from the first board, and mounted with a second electrode switch section receiving the driving power from the power supply section through a cable and switching the driving power to supply the switched driving power to a second electrode of the plasma display panel.

Power remaining after being consumed to drive the plasma display panel may be transmitted to the power supply section by resonance between the inductance of the power supply section and capacitance of the plasma display panel.

The power supply section may include the power conversion section receiving and switching power to convert the power into the driving power.

The power conversion section may perform a switching operation interlocked with a switching operation of the first and second electrode switch sections.

The power conversion section may include: a first power switch switching input power; a second power switch alternately switching the input power together with the first power switch and performing power conversion together with the first power switch; and a transformer transforming the power converted by the first and second power switches according to a turns ratio between a primary winding and a secondary winding to output the driving power.

The driver first electrode switch section and the second electrode switch section may switch the driving power according to a logic signal to charge and discharge the display panel with the driving power, the first electrode switch section may include first and second switches connected in series with each other, and the second electrode switch section may include third and fourth electrode switches connected in series with each other, the first electrode switch may be turned on and off together with the fourth electrode switch, the second electrode switch may be turned on and off together with the third electrode switch while the second and third electrode switches and the first and fourth electrode switches alternately perform switching operations, and a connection node of the first and second electrode switches may be connected to the first electrode of the plasma display panel, and a connection node of the third and fourth electrode switches is connected to the second electrode of the plasma display panel.

The driver first power switch may be turned on when the second electrode switch and the third electrode switch are turned on, the second power switch and the first power switch may be alternately turned on when the first electrode switch and the fourth power switch are turned on, and a connection terminal of the first and second power switches may be connected to the primary winding of the transformer.

A body diode of the second power switch may conduct during dead time when the first and second electrode switches and the third and fourth electrode switches are turned off to thereby form a path through which the remaining power is transmitted to the power conversion section from the first and second electrode switch sections, when voltage of the plasma display panel rises, a body diode of the first power switch may conduct during dead time when the first and second electrode switches and the third and fourth electrode switches are turned off to thereby form a path through which the remaining power is transmitted to the power conversion section from the first and second electrode switch sections, when voltage of the plasma display panel falls, and the inductance of the power supply section and the capacitance of the plasma display panel may produce an LC resonance when the path is formed.

The driver first and second electrode switches and the third and fourth electrode switches may be turned off, and the first power switch may be turned on and then turned off at a rising voltage interval of the plasma display panel, so that the body diode of the second power switch conducts, The first and second electrode switches and the third and fourth electrode switches may be turned off, and the second power switch may be turned on and then turned off at a falling voltage interval of the plasma display panel, so that the body diode of the first power switch conducts.

The driver first electrode switch and the fourth electrode switch may be turned on, the second electrode switch and the third electrode switch may be turned off, and the second power switch may be turned on when a maximum voltage of the plasma display panel is maintained from the rising voltage interval to the falling voltage interval of the plasma display panel, and the second electrode switch and the third electrode switch may be turned on, the first electrode switch and the fourth electrode switch may be turned off, and the first power switch may be turned on when a minimum voltage of the plasma display panel is maintained from the falling voltage interval to the rising voltage interval of the plasma display panel.

The first electrode may be a Y electrode of the plasma display panel, and the second electrode may be an X electrode of the plasma display panel.

The first electrode may be an X electrode of the plasma display panel, and the second electrode may be a Y electrode of the plasma display panel.

The power supply section may include: a rectifying/smoothing unit rectifying and smoothing the commercial AC power; and a power factor correction unit correcting a power factor of the power from the rectifying/smoothing unit to supply DC power to the power conversion section.

The driver inductance may be leakage inductance of the transformer, inductance of an inductor element electrically connected in series between the connection node of the first and second power switches and the primary winding of the transformer, or composite inductance of the leakage inductance of the transformer and the inductance of the inductor element.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
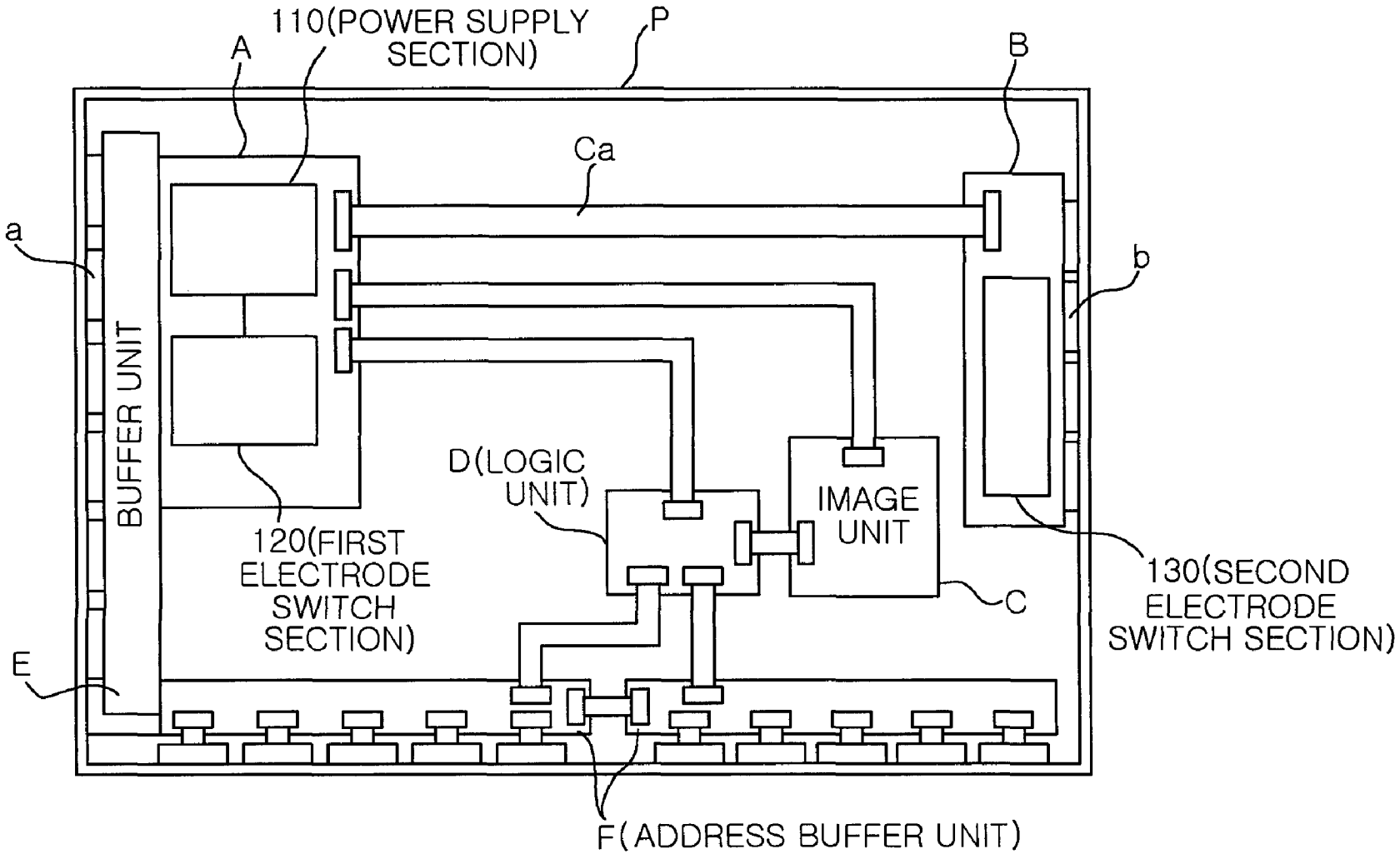
FIG. 1 is a schematic configuration view illustrating a driver mounted on a rear surface of a liquid crystal panel according to an exemplary embodiment of the present invention.

FIG. 1 is a view illustrating the configuration of a driver that is mounted on a rear surface of a plasma display panel module according to an exemplary embodiment of the invention.

Referring to FIG. 1, a first board A and a second board B each having a predetermined mounting area may be arranged on a rear surface of a plasma display panel module P. The first board A and the second board B may be physically separated from each other. The first board A may be arranged on one side of the rear surface of the plasma display panel module P, while the second board B may be arranged on the other side of the rear surface of the plasma display panel module P so that the second board B may face the first board A.

A power supply section 110 and a first electrode switch section 120 may be mounted on the first board A, while a second electrode switch section 130 may be mounted on the second board B.

Furthermore, a plurality of boards C, D, E and F may be further arranged on the rear surface of the plasma display panel module P. An image unit that controls an image being displayed on the plasma display panel may be mounted on the third board C. A logic unit that supplies a logic signal on the basis of the image control of the image unit may be mounted on the fourth board D. A buffer unit that transmits power from the first electrode switch section 120 to a first electrode a may be mounted on the fifth board E. An address buffer unit that transmits a signal to an address electrode of the plasma display panel may be mounted on the sixth board F.

The power supply section 110 of the first board A may receive commercial AC power to supply driving power having a predetermined DC voltage level. The first electrode switch section 120 switches the driving power, which is supplied by the power supply section 110, and supplies the switched driving power to the first electrode a of the plasma display panel, so that the plasma display panel may be charged or discharged with the power.

The second electrode switch section 130 of the second board B receives the driving power from the power supply section 110 of the first board A. Here, the second electrode switch section 130 receives the driving power from the power supply section 110 of the first board A through a cable Ca, and switches the driving power to supply the switched driving power to a second electrode b of the plasma display panel, so that the plasma display panel may be charged and discharged with the power.

The above-described driver according to this embodiment will now be described in detail with reference to the drawings.

Figure 2:
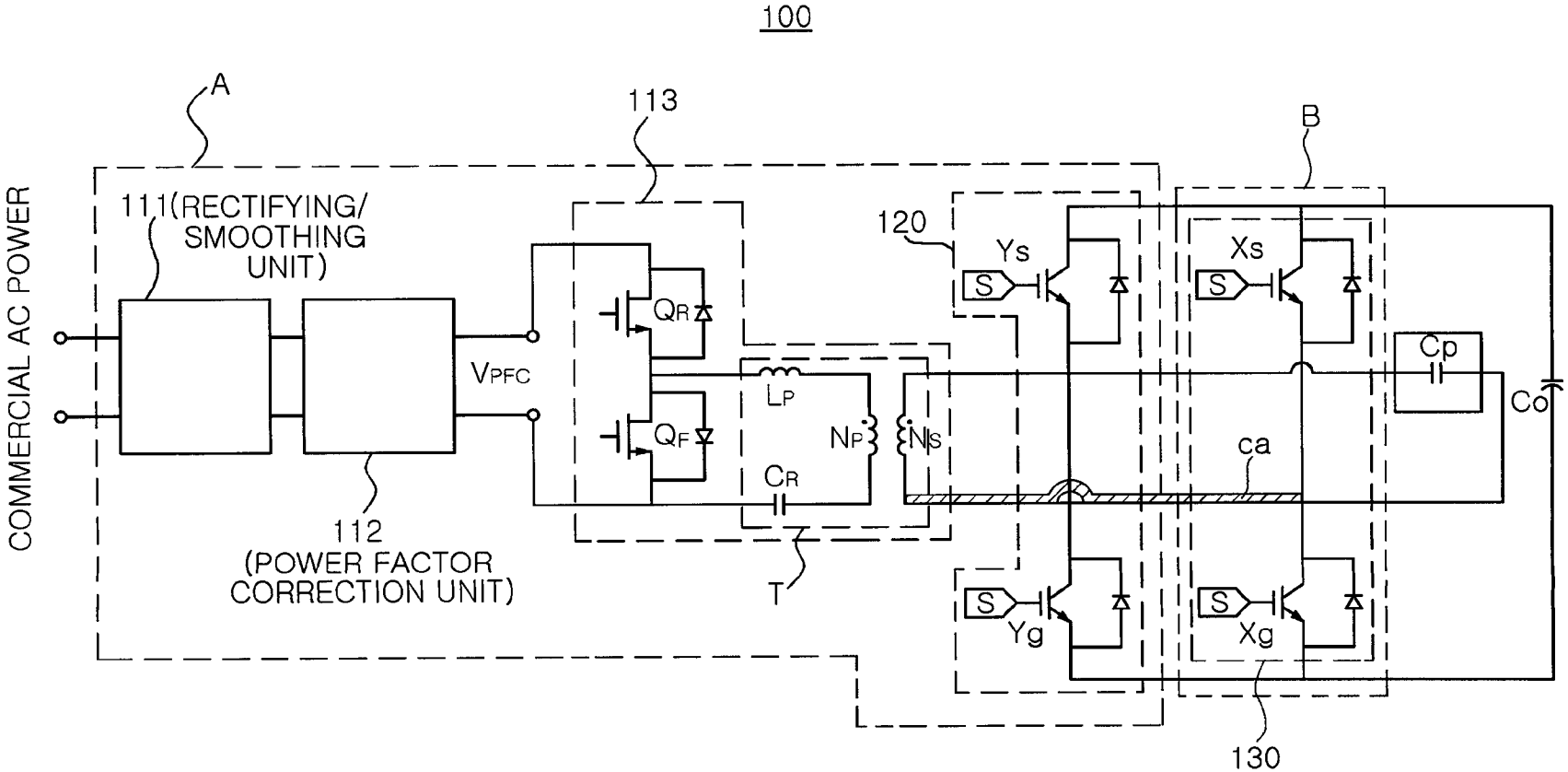
FIG. 2 is a schematic view illustrating the configuration of a driver according to an exemplary embodiment of the present invention.

FIG. 2 is a schematic view illustrating the configuration of a driver according to an exemplary embodiment of the invention.

Referring to FIG. 2, the driver 100 according to this embodiment may include the power supply section 110 and the first electrode switch section 120, which are mounted on the first board A, and the second electrode switch section 130, which is mounted on the second board B.

The power supply section 110 may include a power conversion unit 113 that switches and converts the power, a rectifying/smoothing unit 111 that rectifies and smoothes commercial AC power, and a power factor correction unit 112 that corrects a power factor of the rectified and smoothed power to supply DC power to the power conversion unit 113.

The power conversion unit 113 may include first and second power switches $Q_R$ and $Q_F$ that switch DC power $V_{PFC}$ and a transformer T that transforms a voltage level of the power, which is switched by the first and second power switches $Q_R$ and $Q_F$.

The first and second power switches $Q_R$ and $Q_F$ may be half bridge type switches that are connected in series with input terminals of DC power from the power factor correction unit 112. Each of the first and second power switches $Q_R$ and $Q_F$ may have a body diode.

The transformer T may include a primary winding Np and a secondary winding Ns, each of which has a predetermined turns ratio, and the primary winding Np may be connected in parallel with the second power switch $Q_F$. Leakage inductance Lp and capacitance $C_R$ may be formed between the primary winding Np and the second power switch $Q_F$. The leakage inductance Lp may be leakage inductance of the transformer T itself or leakage inductance caused by an inductor element additionally connected.

The first electrode switch section 120 may include first and second electrode switches Ys and Yg that are connected in series with each other. A connection node between the first and second electrode switches Ys and Yg, which are connected in series with each other, may be electrically connected to one end of the secondary winding Ns of the transformer T and a first electrode of the plasma display panel Cp.

In the same manner, the second electrode switch section 130, which is mounted on the second board B, may include third and fourth electrode switches Xs and Xg that are connected in series with each other. A connection node of the third and fourth electrode switches Xs and Xg, which are connected in series with each other, may be electrically connected to the other end of the secondary winding Ns of the transformer T through a cable Ca and a second electrode of the plasma display panel Cp.

Here, the first electrode may be a Y electrode of the plasma display panel Cp, and correspondingly, the second electrode may be an X electrode of the plasma display panel Cp. In the same manner, the first electrode may be the X electrode of the plasma display panel Cp, and correspondingly, the second electrode of the plasma display panel Cp may be a Y electrode.

The first and second electrode switches Ys and Yg may be connected in parallel with the third and fourth electrode switches Xs and Xg. The switching operations of the first and second power switches $Q_R$ and $Q_F$ of the power conversion unit 113 are interlocked with those of the first and second electrode switches Ys and Yg and the third and fourth electrode switches Xs and Xg to thereby form an LC resonance path between the leakage inductance Lp of the transformer T and the capacitance Cp of the plasma display panel, so that power remaining after being consumed to drive the plasma display panel is transmitted to the power conversion unit 113 so as to replace the function of an existing Energy Recovery Circuit (ERC).

Here, the above-described replacing of the function of the existing ERC will now be described in detail with reference to the accompanying drawings.

Figure 3A:
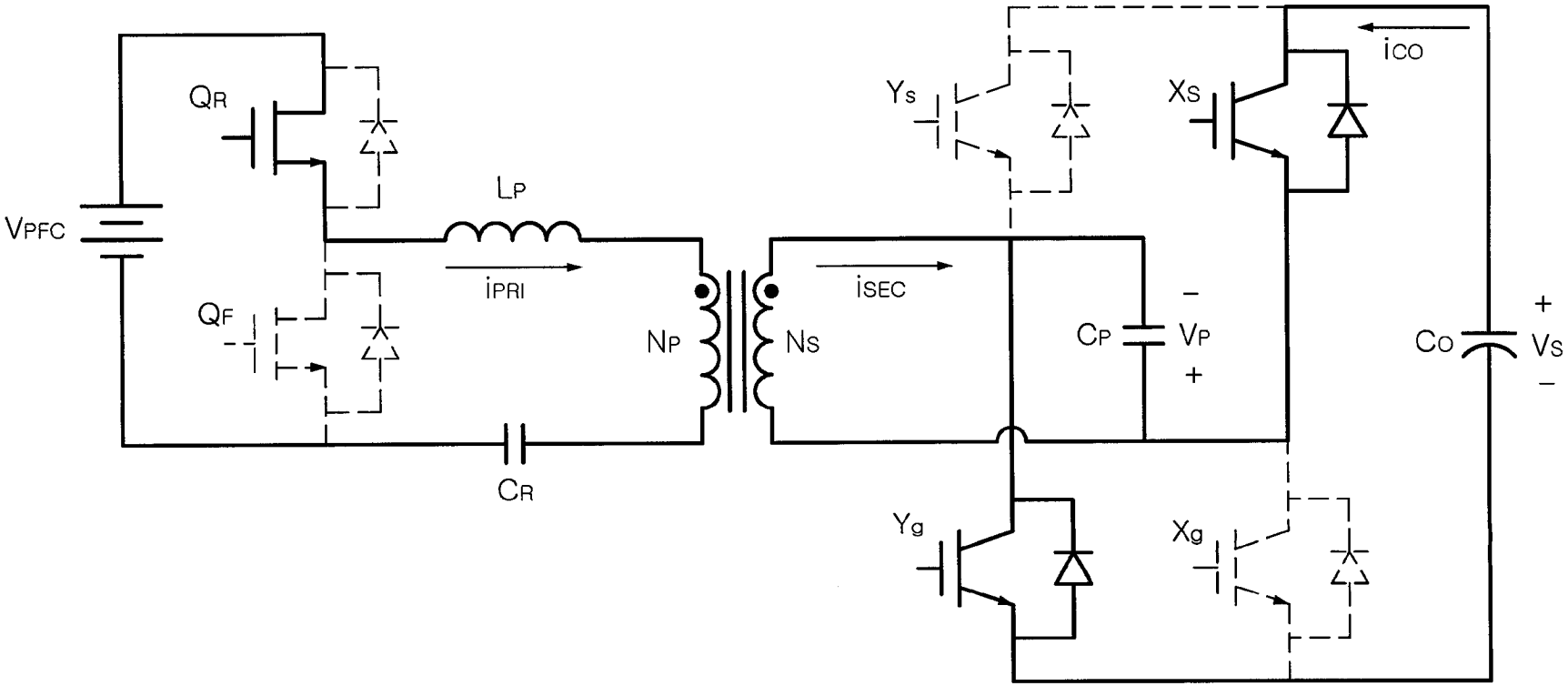
FIGS. 3A through 3I are diagrams illustrating the current flow of a driver for a plasma display panel according to operating modes according to an exemplary embodiment of the present invention.

FIGS. 3A through 3I are diagrams illustrating the current flow of the driver for a plasma display panel, shown in FIG. 2, according to operating modes. FIG. 4 is a signal waveform graph of main parts of a driver for a plasma display panel in the operating modes, illustrated in FIGS. 3A through 3I.

In FIGS. 3A through 3I, the current flow is indicated by the solid line. First, referring to FIGS. 3A and 4, in order to supply power to the plasma display panel Cp, the first power switch $Q_R$, the second electrode switch Yg, and the third electrode switch Xs are turned on. Therefore, a voltage of $(1/2)V_{PFC}+(Np/Ns)Vs$ is applied to the leakage inductance Lp, and a primary-side current $I_{PRI}$ of the transformer T rises linearly. Here, a voltage Vs of a capacitor Co is discharged so that a current ico flows in the reverse direction (mode 0 of FIG. 4).

Figure 3B:
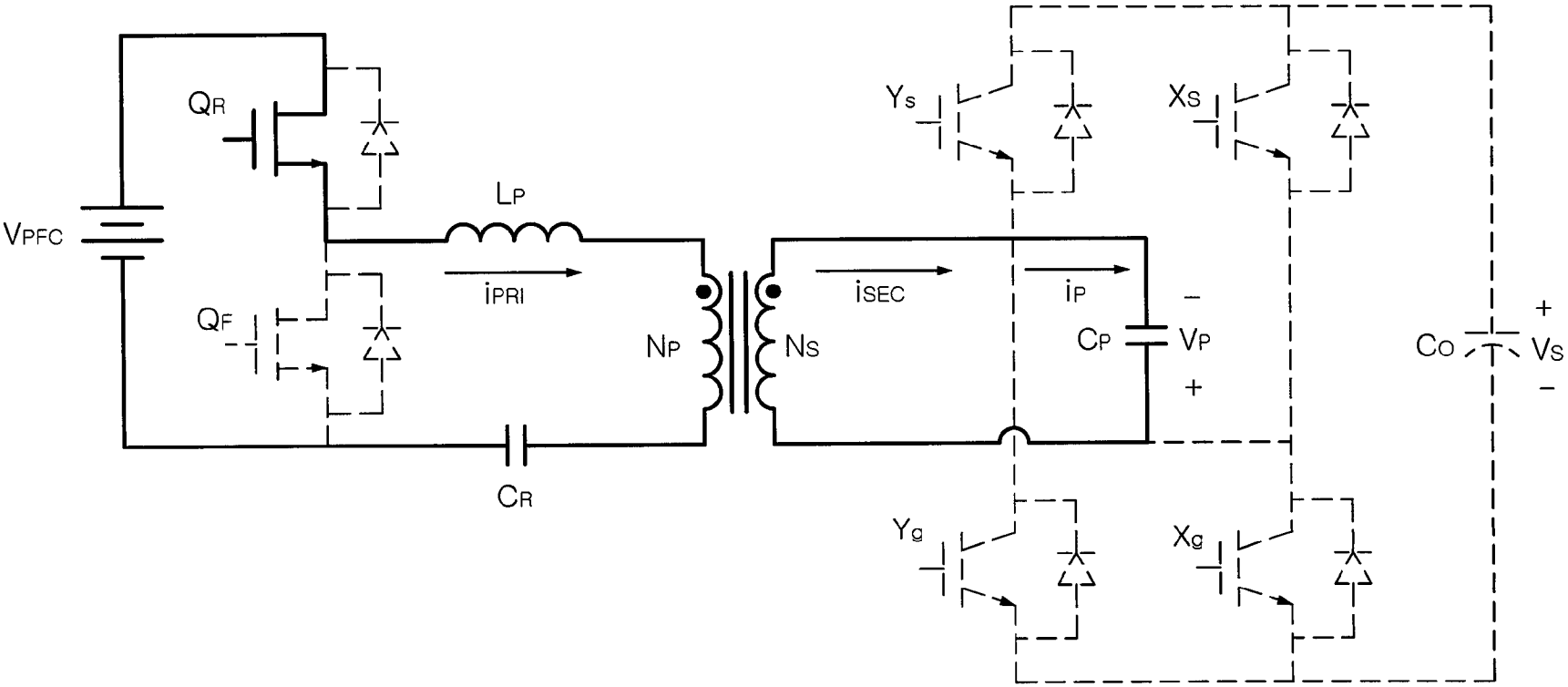
Figure 4:
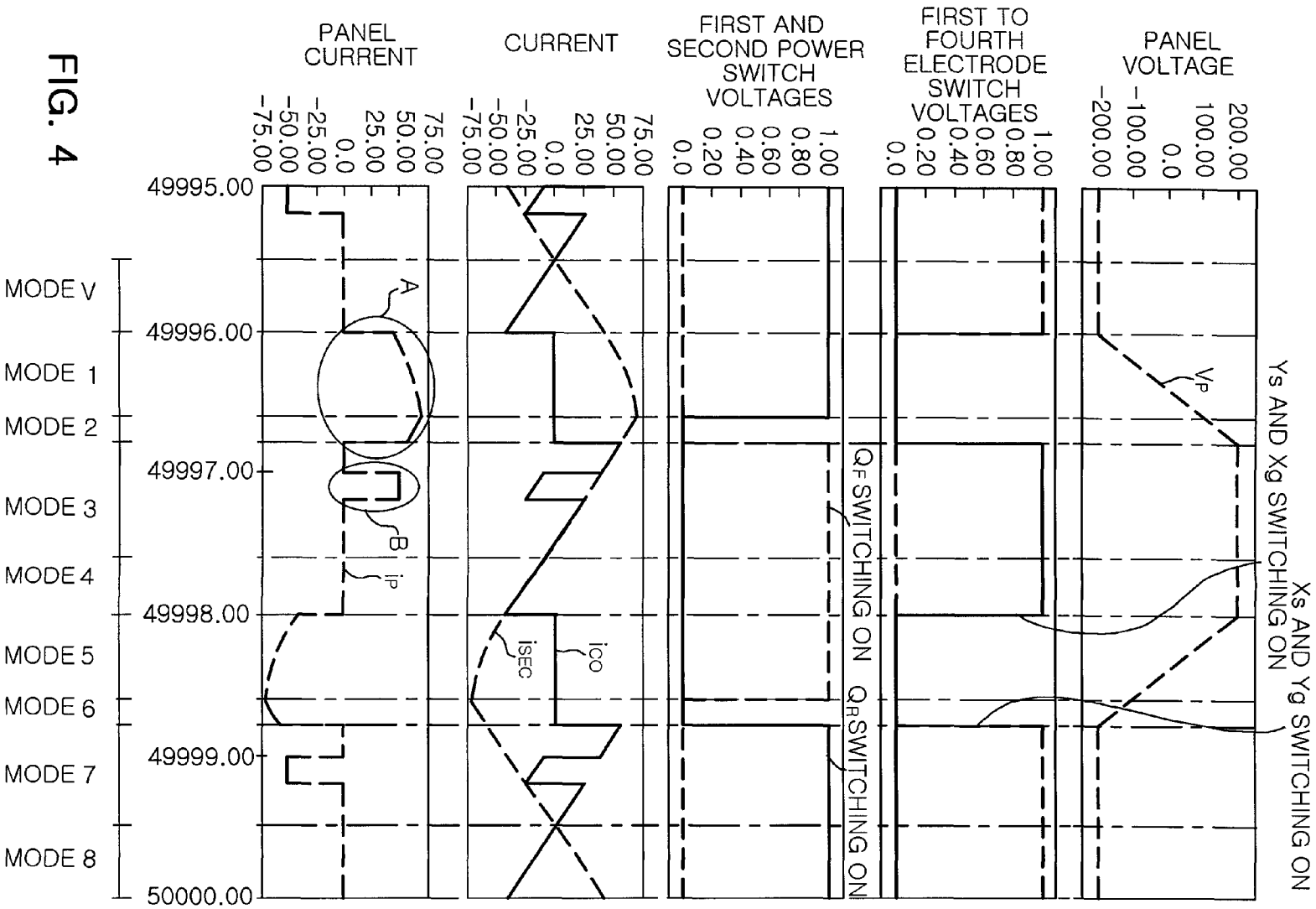
FIG. 4 is a signal waveform graph of main parts of a driver for a plasma display panel in the operating modes, illustrated in FIGS. 3A through 3I.

Then, referring to FIG. 3B and FIG. 4, while the first power switch $Q_R$ is turned on, the second electrode switch Yg and the third electrode switch Xs are turned off, whereby a resonant path is formed so that an LC resonance occurs between the leakage inductance Lp and the capacitance Cp of the plasma display panel. Therefore, a voltage Vp with which the plasma display panel is charged rises. Here, since the current ico is zero, an existing level of the voltage Vs is maintained (mode 1 of FIG. 4). In FIG. 4, reference character A refers to a displacement current at this time.

Figure 3C:
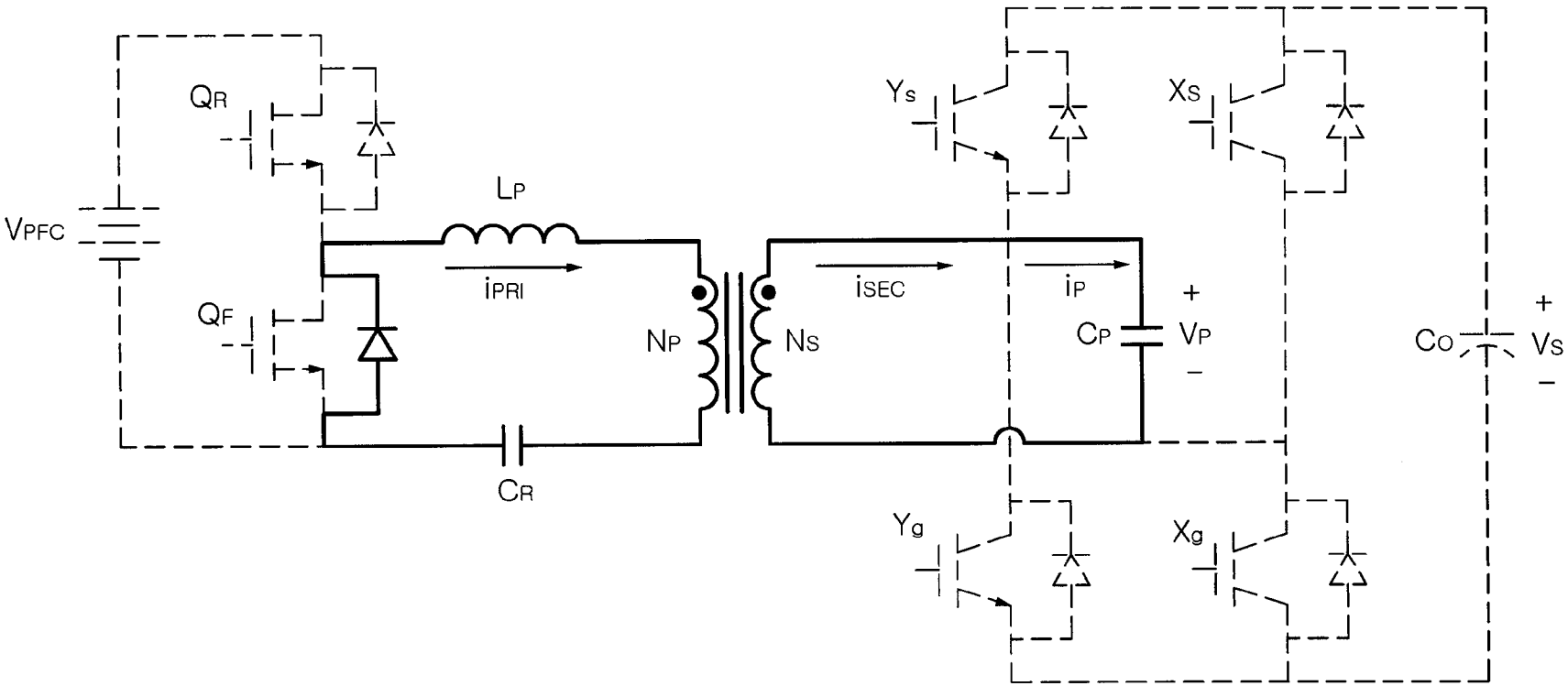

Referring to FIG. 3C and FIG. 4, the first power switch $Q_R$, the second electrode switch Yg and the third electrode switch Xs are turned off, and the body diode of the second power switch $Q_F$ conducts. Here, the leakage inductance Lp and the capacitance Cp of the plasma display panel continue to form the LC resonance, so that the voltage Vp with which the plasma display panel is charged keeps increasing, while the existing level of the voltage Vs is maintained since the current ico is zero (mode 2 of FIG. 4).

Figure 3D:
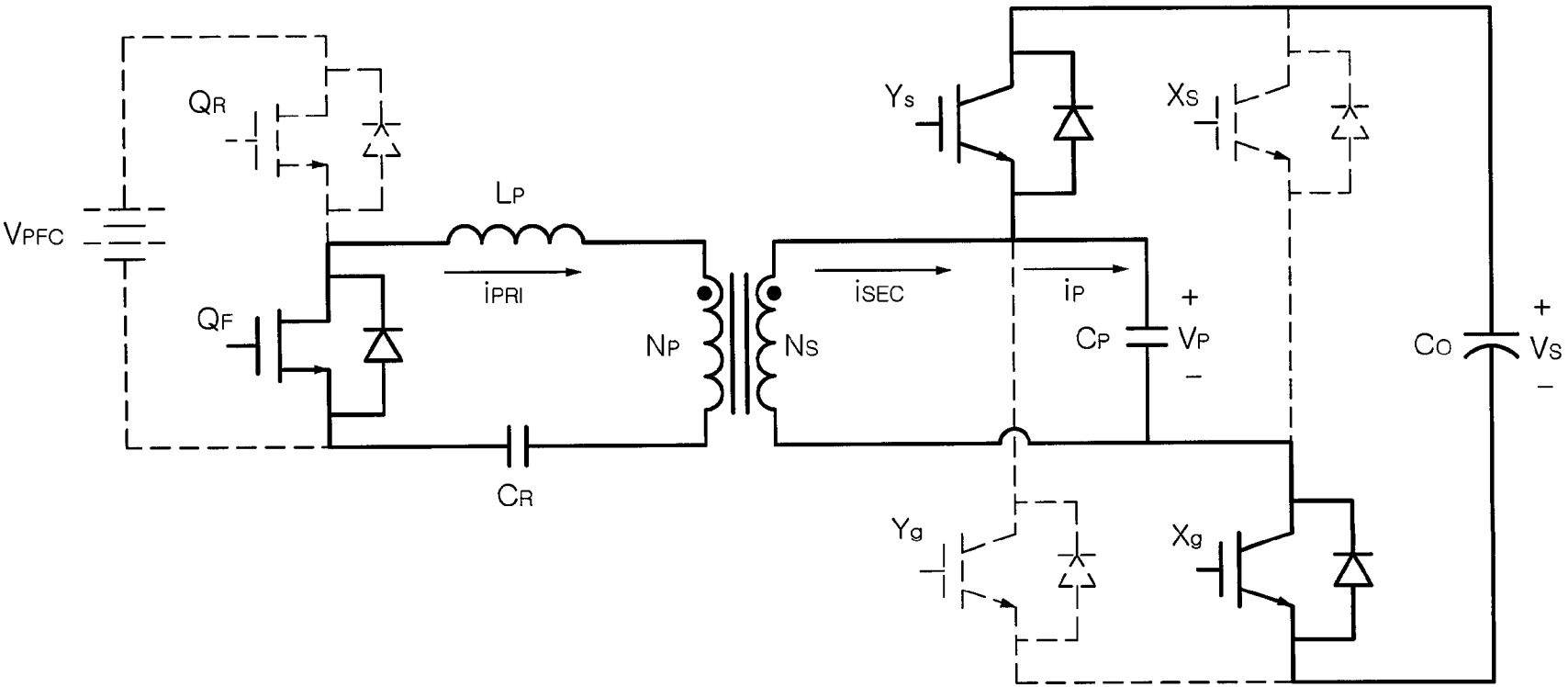

Referring to FIG. 3D and FIG. 4, when a voltage level of the voltage Vp with which the plasma display panel is charged becomes equal to that of the voltage Vs with which the capacitor Co is charged, the first electrode switch Ys and the fourth electrode switch Xg are turned on, so that a voltage level of the voltage Vp with which the plasma display panel is charged is maintained at the voltage level of the voltage Vs with which the capacitor Co is charged. Here, a voltage of $-(1/2)V_{PFC}-(Np/Ns)Vs$ is applied to the leakage inductance Lp, and the primary-side current $I_{PRI}$ of the transformer T falls linearly. The current ico flows in the forward direction, so that the stabilization capacitor Co is charged with the voltage Vs, and a voltage level exceeding the voltage level of the voltage Vp with which the plasma display panel is charged is discharged again. In order to discharge the voltage Vp with which the plasma display panel is charged, the second power switch $Q_F$ is turned on (mode 3 of FIG. 4). Here, in FIG. 4, reference character B refers to discharge current at this time.

Figure 3E:
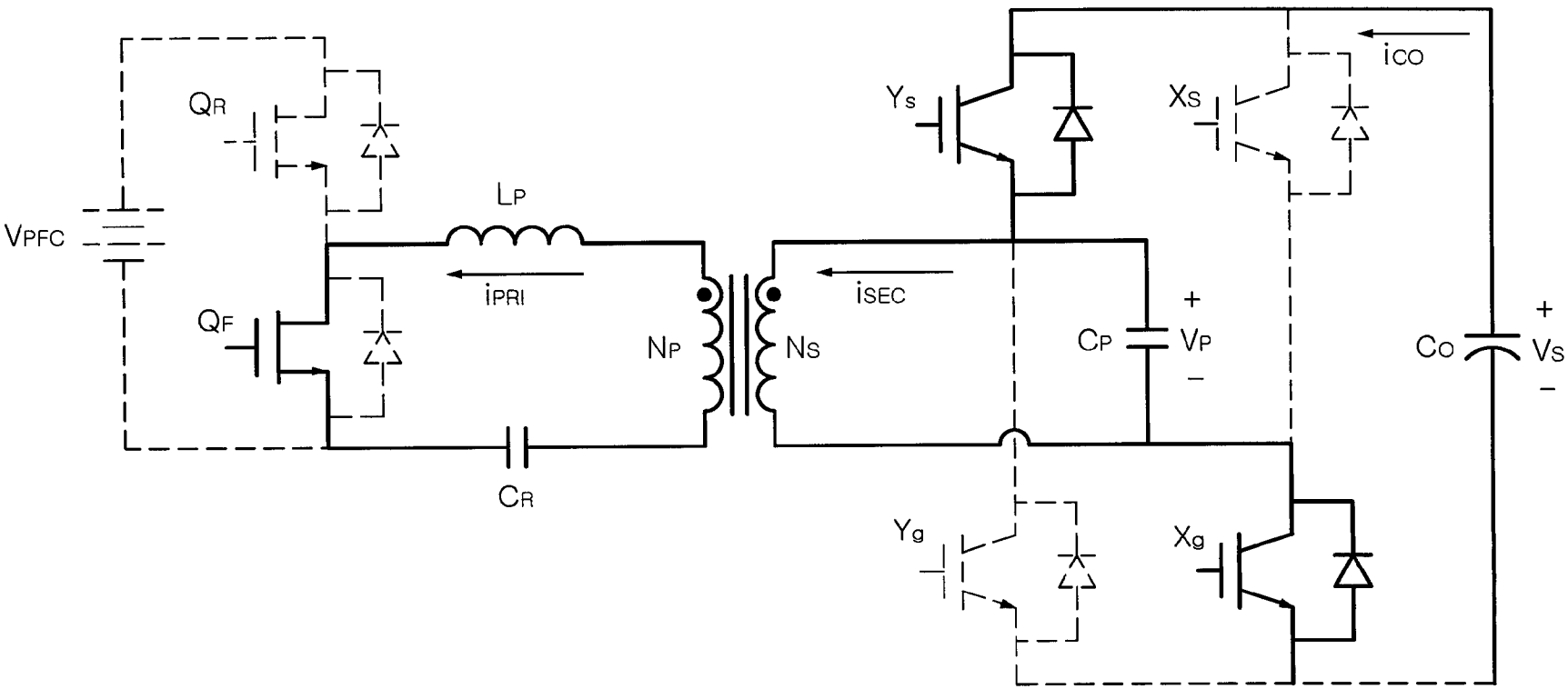

Referring to FIG. 3E and FIG. 4, the second power switch $Q_F$, the first electrode switch Ys, and the fourth electrode switch Xg are turned on. Further, as a voltage of $-(1/2)V_{PFC}-(Np/Ns)Vs$ is applied to the leakage inductance Lp, the primary-side current $I_{PRI}$ of the transformer T is linearly decreasing, and the current ico flows in the reverse direction, so that the voltage Vs in the capacitor Co is discharged (mode 4 of FIG. 4).

Figure 3F:
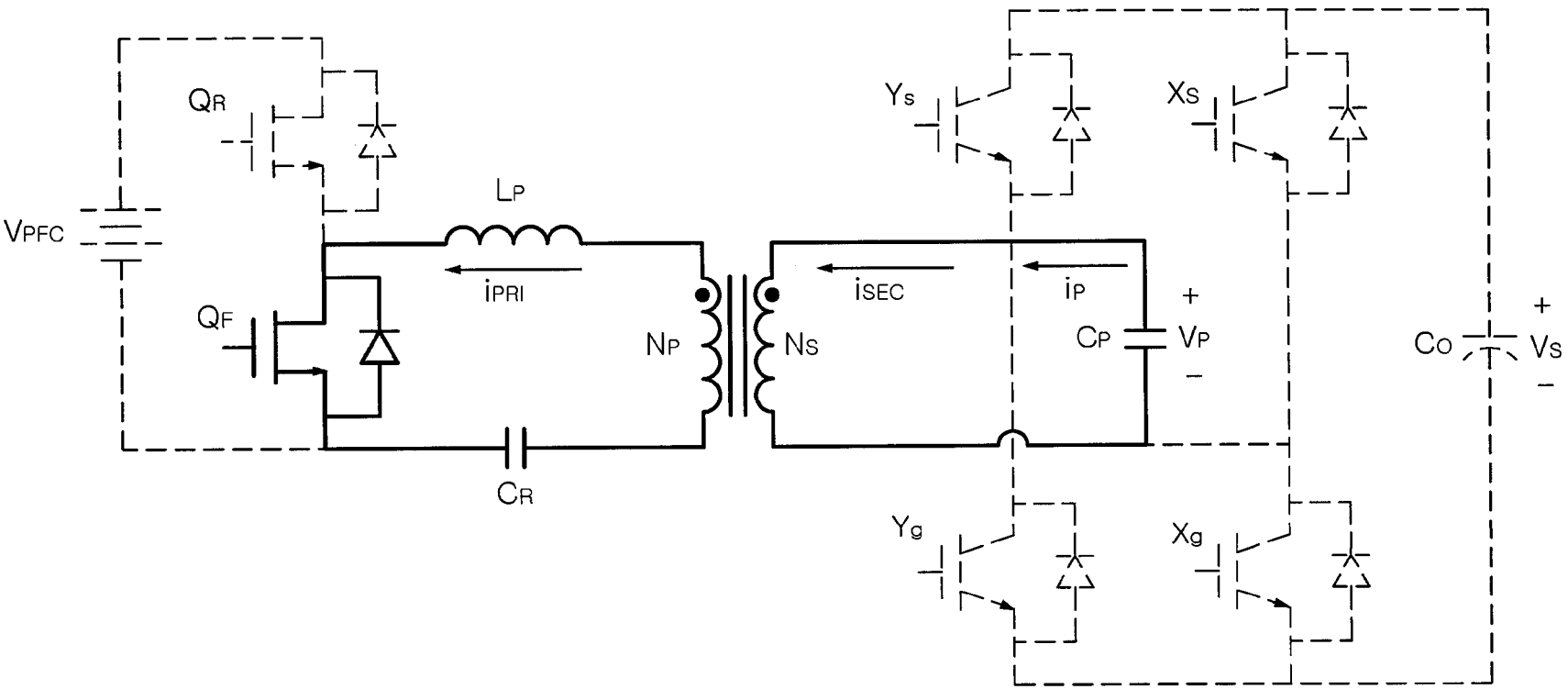

Referring to FIGS. 3F and 4, the second power switch $Q_F$ is turned on, and the first electrode switch Ys and the fourth electrode switch Xg are turned off to thereby form a resonant path. Therefore, an LC resonance occurs between the leakage inductance Lp and the capacitance Cp of the plasma display panel, and the voltage Vp with which the plasma display panel is charged decreases correspondingly. Here, since the current ico is zero, the voltage level of the voltage Vs in the capacitor Co is maintained (mode 5 of FIG. 4).

Figure 3G:
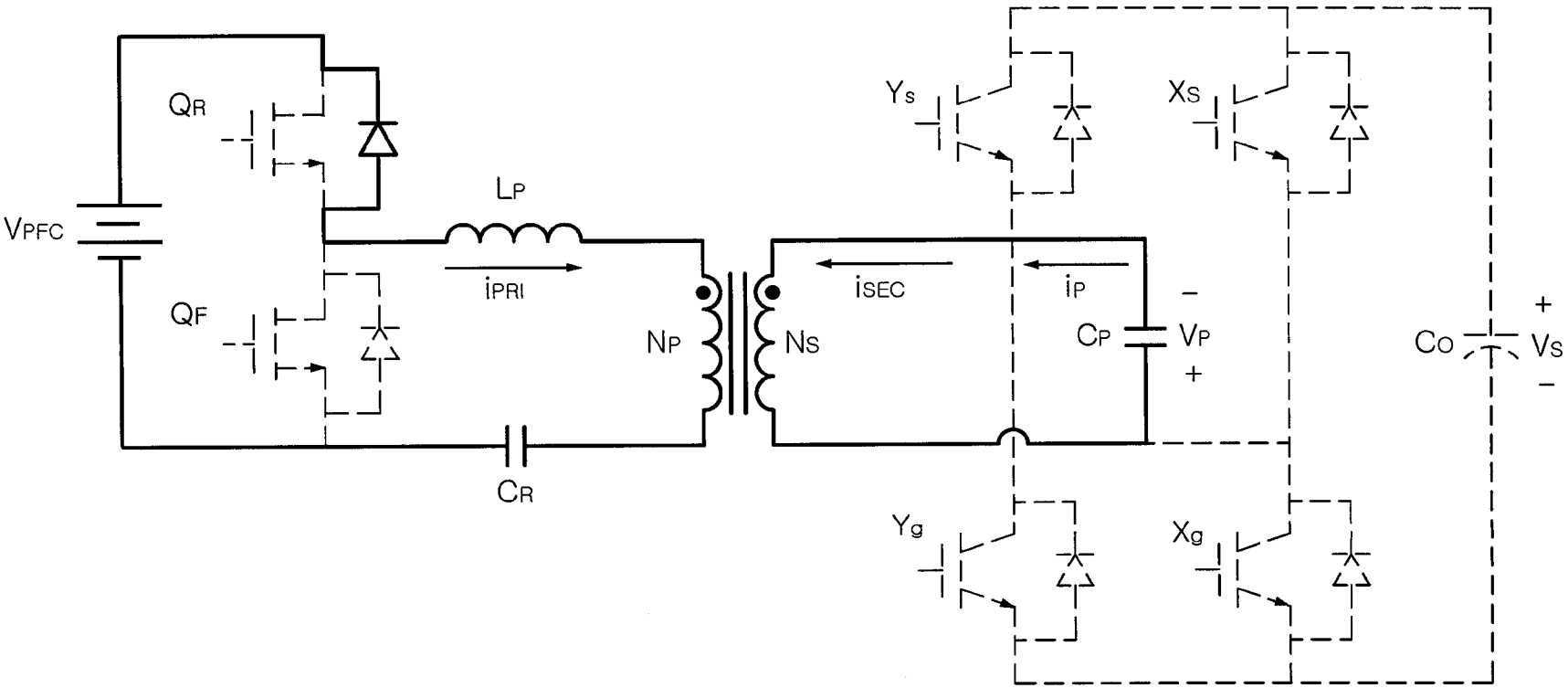

Referring to FIG. 3G and FIG. 4, the second power switch $Q_F$, the first electrode switch Ys, and the fourth electrode switch Xg are turned off, and the body diode of the first power switch $Q_R$ conducts. Here, the LC resonance occurring between the leakage inductance Lp and the capacitance Cp of the plasma display panel is continued, so that the voltage Vp with which the plasma display panel is charged continues to fall, and the existing voltage level of the voltage Vs is maintained since the current ico is zero (mode 6 of FIG. 4). As described above, as shown in FIGS. 3B, 3C, 3F and 3G, a transfer path is formed so that power remaining after being consumed to drive the plasma display panel is transmitted to the power supply section 110.

Figure 3H:
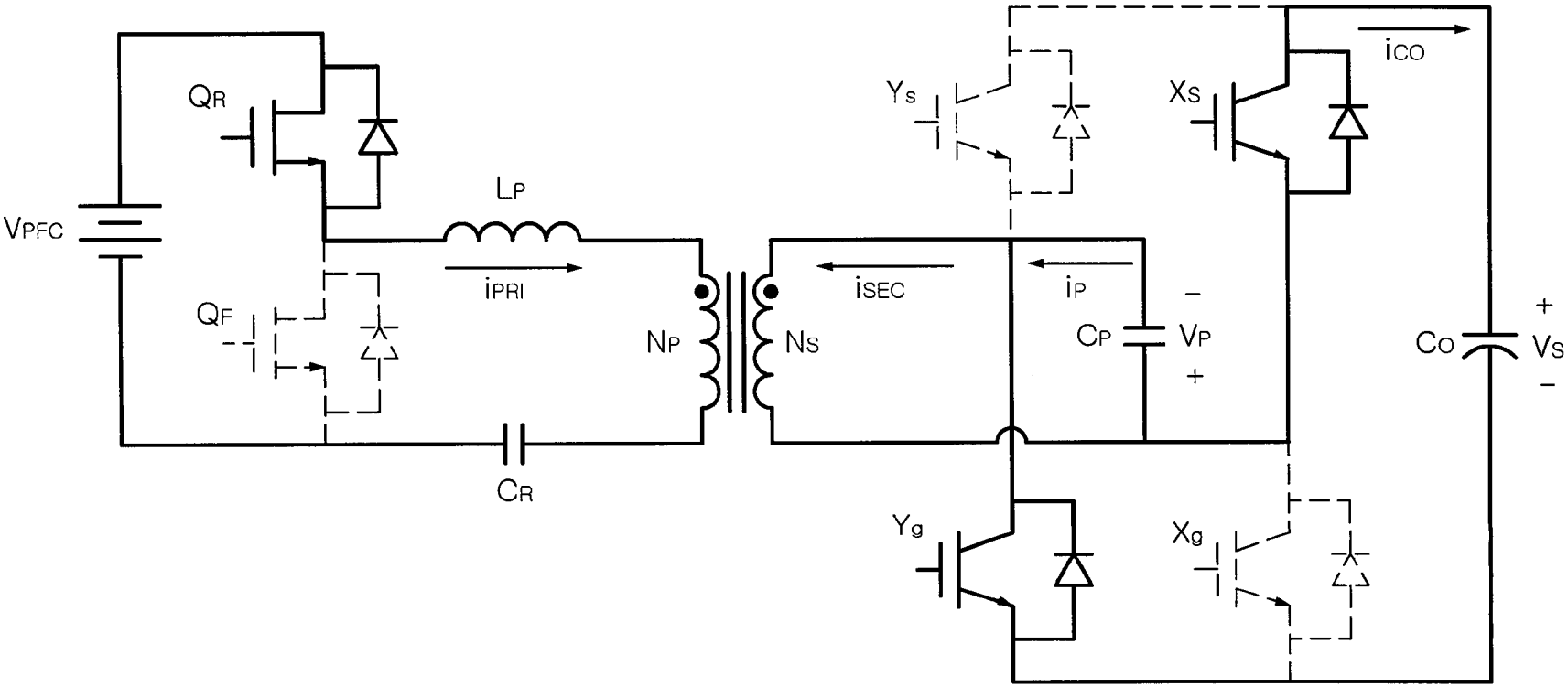

Referring to FIG. 3H and FIG. 4, when the voltage Vp, with which the plasma display panel is charged, and the voltage Vs, with which the stabilization capacitor Co has been charged, have the same voltage level and opposite signs, the second electrode switch Yg and the third electrode switch Xs are turned on, so that the voltage Vp, with which the plasma display panel is charged, and the voltage Vs, with which the stabilization capacitor Co has been charged, have the same voltage level and opposite signs. Here, a voltage of $(1/2)V_{PFC}+(Np/Ns)Vs$ is applied to the leakage inductance Lp, and the primary-side current $I_{PRI}$ of the transformer T rises linearly. The current ico flows in the forward direction, the capacitor Co is charged with the voltage Vs, and a voltage level exceeding the voltage level of the voltage Vp with which the plasma display panel is charged is discharged. In order to discharge the voltage Vp with which the plasma display panel is charged, the second power switch $Q_F$ is turned on (mode 7 of FIG. 4). Here, discharge current has an opposite sign with respect to B, illustrated in FIG. 4.

Figure 3I:
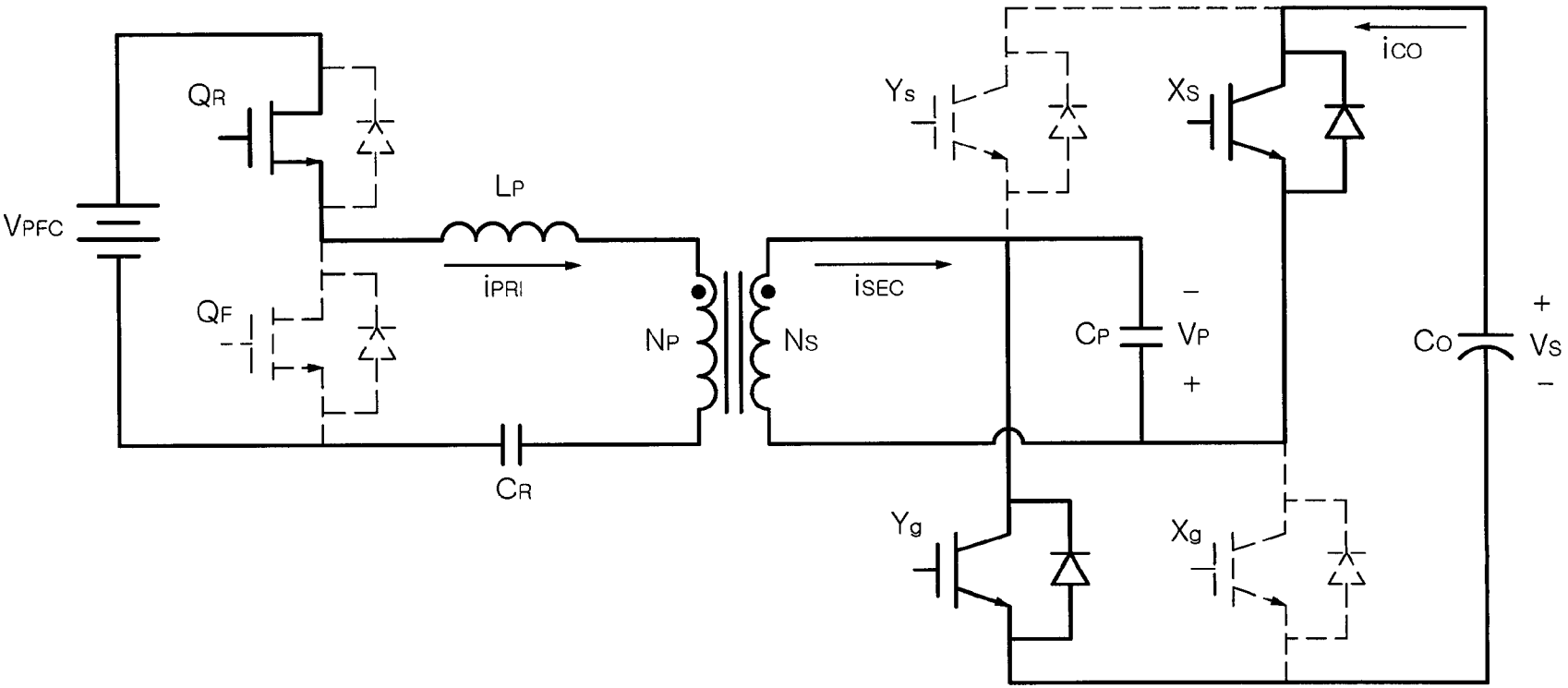

Referring to FIG. 3I and FIG. 4, in order to supply power to the plasma display panel Cp as shown in FIG. 3A, the first power switch $Q_R$, the second electrode switch Yg and the third electrode switch Xs are turned on. Therefore, a voltage of $(1/2)V_{PFC}+(Np/Ns)Vs$ is applied to the leakage inductance Lp, and the primary-side current $I_{PRI}$ of the transformer T rises linearly. Here, the voltage Vs of the capacitor Co is discharged, and the current ico flows in the reverse direction (mode 8 of FIG. 4). Then, the above-described operating modes are repeated.

As described above, without using a separate Energy Recovery Circuit (ERC) that absorbs the power remaining after being supplied to the plasma display panel, the switching operation of a power conversion switch is interlocked with the switching operations of the Y electrode switch and the X electrode switch to form an LC resonance path of leakage inductance of the transformer and capacitance of the plasma display panel, so that the remaining power is transmitted to the power conversion unit, thereby replacing the function of the existing ERC and reducing the circuit area and the number of components of the circuit. Therefore, a reduction in weight, thickness and size and manufacturing costs can be achieved.

The individual components of the driver according to the embodiment may be separately mounted on a separated board in order to reduce parasitic resonance. That is, as described above, the power supply section 110 and the first electrode switch section 120 may be mounted on the first board A, while the second electrode switch section 130 may be mounted on the second board B. A reduction in parasitic resonance will be described in detail with reference to the accompanying drawings.

Figure 5A:
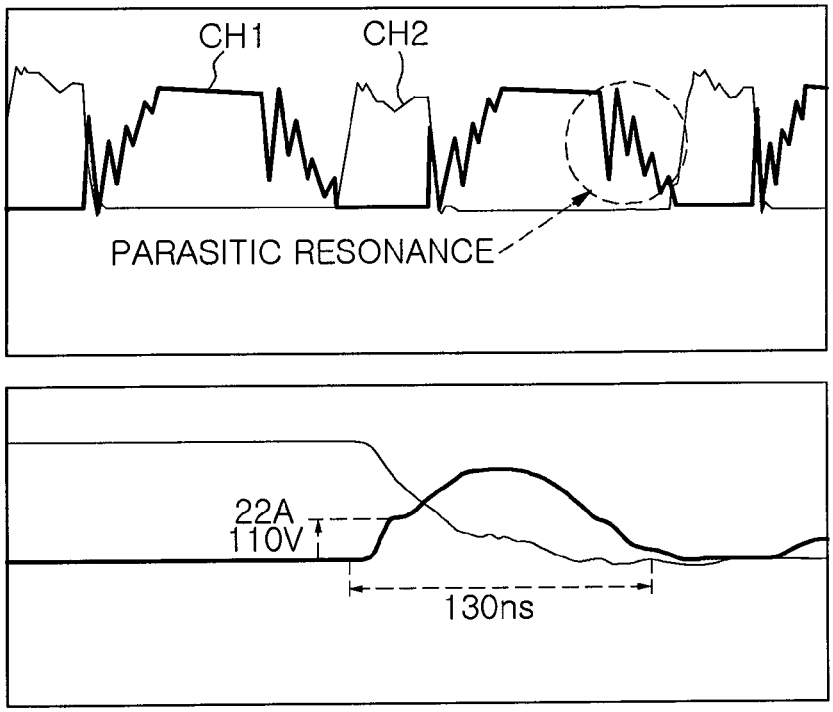
FIGS. 5A and 5B are graphs illustrating power waveforms.
Figure 5B:
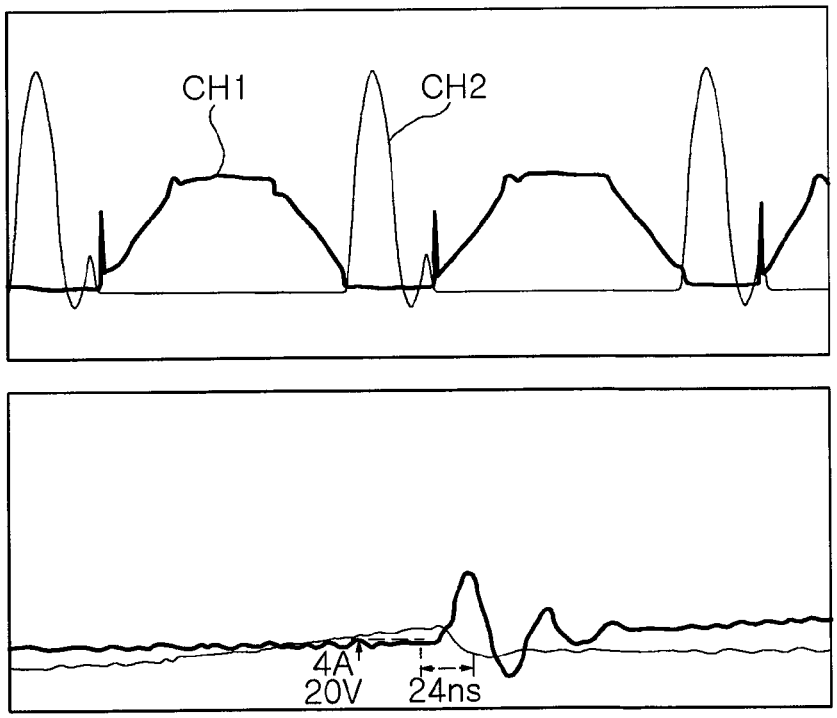

FIGS. 5A and 5B are graphs illustrating power waveforms.

In FIG. 5A, voltage, current and energy pulse waveforms occurring in an electrode switch are illustrated when the power supply section 110 and the first and second electrode switch sections 120 and 130 are mounted on a single board. As described above, when the power supply section 110 and the first and second electrode switch sections 120 and 130 are mounted on the single board, the first and second electrodes of the plasma display panel need to be arranged at both ends of the plasma display panel. When power is transmitted through a cable, cable length for power transmission and ground connection is required. As a result, parasitic resonance occurs between a capacitance component of the plasma display panel and a parasitic inductance component corresponding to the cable length, so that voltage distortion occurs as shown in the upper graph of FIG. 5A. Here, reference character CH1 refers to voltage at a third electrode switch, and reference character CH2 refers to current at the third electrode switch. Energy pulse caused by the above-described parasitic resonance is shown in the lower graph of FIG. 5A. The energy pulse caused by the parasitic resonance satisfies voltage×current×time. That is, the energy pulse has a value of approximately 387.2 uWs according to 110V*22 A*160 ns. Heat is generated in the third electrode switch from the above-described pulse value of 387.2 uWs.

However, like the driver according to this embodiment that has a separated board structure, for example, when the power supply section 110 and the first electrode switch section 120 are mounted on the first board A, and the second electrode switch section 130 is mounted on the second board B, a cable only needs to have a length necessary to transmit power from the other end of the transformer T of the power supply section 110 to the second electrode switch section 130. Therefore, the cable length is reduced, compared to the cable length in FIG. 5A, to thereby reduce a parasitic inductance component, which results in a reduction in parasitic resonance.

Therefore, a graph of FIG. 5B may be obtained. In the same manner, reference character CH1 refers to voltage at the third electrode switch, and the reference character CH2 refers to current at the third electrode switch. Energy pulse caused by the reduced parasitic resonance is shown in the lower graph of FIG. 5B. The energy pulse caused by parasitic resonance has a value of approximately 1.92 uWs according to 20V*40 A*24 ns. Heat generation at the third electrode switch is shown to be significantly reduced as compared to that in FIG. 5A.

As described above, according to an exemplary embodiment of the invention, cable length used for power transmission is reduced by separating a board having a Y electrode switch formed thereon and a board having an X electrode switch formed thereon from each other to thereby reduce parasitic resonance, thereby preventing waveform distortion of power and reducing heat generation of switches in an integrated board structure for a reduction in weight, thickness and size.

As set forth above, according to exemplary embodiments of the invention, in a power supply supplying power to a plasma display panel, cable length used for power transmission is reduced by separating a board having a Y electrode switch formed thereon and a board having an X electrode switch formed thereon from each other to thereby reduce parasitic resonance, thereby preventing waveform distortion of power and reducing heat generation of switches in an integrated board structure for a reduction in weight, thickness and size.

While the present invention has been shown and described in connection with the exemplary embodiments, it will be apparent to those skilled in the art that modifications and variations can be made without departing from the spirit and scope of the invention as defined by the appended claims.

What is claimed is:

1. A driver for a plasma display panel having a separated board structure, the driver comprising:

a first board having a predetermined mounting area, and mounted with a power supply section having a predetermined inductance and configured to convert a commercial alternate-current (AC) power into a predetermined driving power using the inductance, the power supply section comprising a power conversion section configured to receive and switch the commercial AC power to convert the commercial AC power into the driving power, and a first electrode switch section configured to switch the driving power from the power conversion section and to supply the switched driving power to a first electrode of the plasma display panel; and a second board having a predetermined mounting area, physically separated from the first board, and mounted with a second electrode switch section configured to receive the driving power from the power supply section through a cable and to switch the driving power to supply the switched driving power to a second electrode of the plasma display panel, wherein a remaining power remaining after driving the plasma display panel is transmitted to the power supply section by a resonance between the inductance of the power supply section and a capacitance of the plasma display panel, and the power conversion section is configured to perform a switching operation interlocked with a switching operation of the first and second electrode switch sections.

2. The driver of claim 1, wherein the power conversion section comprises:

a first power switch configured to switch an input power;

a second power switch configured to alternately switch the input power together with the first power switch and to perform a power conversion together with the first power switch; and a transformer configured to transform the power converted by the first and second power switches according to a turns ratio between a primary winding and a secondary winding to output the driving power.

3. The driver of claim 2, wherein the inductance is a leakage inductance of the transformer, an inductance of an inductor element electrically connected in series between a connection node of the first and second power switches and the primary winding of the transformer, or a composite inductance of the leakage inductance of the transformer and the inductance of the inductor element.

4. The driver of claim 1, wherein the first electrode switch section and the second electrode switch section are configured to switch the driving power according to a logic signal to charge and discharge the plasma display panel with the driving power, the first electrode switch section comprises first and second electrode switches connected in series with each other, and the second electrode switch section comprises third and fourth electrode switches connected in series with each other, the first electrode switch is configured to be turned on and off together with the fourth electrode switch, the second electrode switch is configured to be turned on and off together with the third electrode switch while the second and third electrode switches and the first and fourth electrode switches alternately perform switching operations, and a connection node of the first and second electrode switches is connected to the first electrode of the plasma display panel, and a connection node of the third and fourth electrode switches is connected to the second electrode of the plasma display panel.

5. The driver of claim 4, wherein the first power switch is configured to be turned on when the second electrode switch and the third electrode switch are turned on, the second power switch and the first power switch are configured to be alternately turned on when the first electrode switch and the fourth electrode power switch are turned on, and a connection node of the first and second power switches is connected to the primary winding of the transformer.

6. The driver of claim 5, wherein a body diode of the second power switch is configured to conduct when the first power switch and the second and third electrode switches are turned off to thereby form a path through which the remaining power is transmitted to the power conversion section from the first and second electrode switch sections, when a voltage of the plasma display panel rises, a body diode of the first power switch is configured to conduct when the second power switch and the first and fourth electrode switches are turned off to thereby form the path through which the remaining power is transmitted to the power conversion section from the first and second electrode switch sections, when the voltage of the plasma display panel falls, and the inductance of the power supply section and the capacitance of the plasma display panel are configured to produce an LC resonance when the path is formed.

7. The driver of claim 6, wherein the first and second electrode switches and the third and fourth electrode switches are configured to be turned off, and the first power switch is configured to be turned on and then turned off at a rising voltage interval of the voltage of the plasma display panel, so that the body diode of the second power switch conducts, and the first and second electrode switches and the third and fourth electrode switches are configured to be turned off, and the second power switch is configured to be turned on and then turned off at a falling voltage interval of the voltage of the plasma display panel, so that the body diode of the first power switch conducts.

8. The driver of claim 7, wherein the first electrode switch and the fourth electrode switch are configured to be turned on, the second electrode switch and the third electrode switch are configured to be turned off, and the second power switch is configured to be turned on when a maximum voltage of the plasma display panel is maintained from the rising voltage interval to the falling voltage interval, and the second electrode switch and the third electrode switch are configured to be turned on, the first electrode switch and the fourth electrode switch are configured to be turned off, and the first power switch is configured to be turned on when a minimum voltage of the plasma display panel is maintained from the falling voltage interval to the rising voltage interval.

9. The driver of claim 1, wherein the first electrode is a Y electrode of the plasma display panel, and the second electrode is an X electrode of the plasma display panel.

10. The driver of claim 1, wherein the first electrode is an X electrode of the plasma display panel, and the second electrode is a Y electrode of the plasma display panel.

11. A driver for a plasma display panel having a separated board structure, the driver comprising:

a first board having a predetermined mounting area, and mounted with a power supply section having a predetermined inductance and configured to convert a commercial alternate-current (AC) power into a predetermined driving power using the inductance, and a first electrode switch section configured to switch the driving power from a power conversion section of the power supply section and to supply the switched driving power to a first electrode of the plasma display panel; and a second board having a predetermined mounting area, physically separated from the first board, and mounted with a second electrode switch section configured to receive the driving power from the power supply section through a cable and to switch the driving power to supply the switched driving power to a second electrode of the plasma display panel, wherein a remaining power remaining after driving the plasma display panel is transmitted to the power supply section by a resonance between the inductance of the power supply section and a capacitance of the plasma display panel, and the power supply section comprises:

a rectifying/smoothing unit configured to rectify and smooth the commercial AC power; and a power factor correction unit configured to correct a power factor of the power from the rectifying/smoothing unit to supply a direct-current (DC) power to the power conversion section.

* * * * *